US010390623B2

(12) United States Patent
Konigsberg

(10) Patent No.: US 10,390,623 B2
(45) Date of Patent: Aug. 27, 2019

(54) NECK PILLOW WITH COMPARTMENT FOR BLANKET

(71) Applicant: Nancy Konigsberg, Jersey City, NJ (US)

(72) Inventor: Nancy Konigsberg, Jersey City, NJ (US)

(73) Assignee: Beekaysage LLC, Jersey City, NJ (US)

( * ) Notice: Subject to any disclaimer, the term of this patent is extended or adjusted under 35 U.S.C. 154(b) by 366 days.

(21) Appl. No.: 14/970,682

(22) Filed: Dec. 16, 2015

(65) Prior Publication Data

US 2017/0027346 A1 Feb. 2, 2017

Related U.S. Application Data

(60) Provisional application No. 62/199,283, filed on Jul. 31, 2015.

(51) Int. Cl.
*A47C 7/38* (2006.01)
*A47G 9/06* (2006.01)

(52) U.S. Cl.
CPC ..... *A47C 7/383* (2013.01); *A47G 9/066* (2013.01)

(58) Field of Classification Search
CPC ..... A47C 7/383; A47C 9/066; A47G 9/10; A47G 9/1045; A47G 9/0223; A47G 9/023; A47G 9/04; A47G 9/06; A47G 9/062; A47G 9/064; A47G 9/066; A47G 9/068; A47G 9/1054
USPC ..... 5/639
See application file for complete search history.

(56) References Cited

U.S. PATENT DOCUMENTS 4,754,512 A * 7/1988 Chao-Yang ..... A47D 15/003 446/226
4,776,049 A * 10/1988 Perron ..... A47C 7/383 297/393
5,046,980 A * 9/1991 Tai ..... A41L 313/10 2/49.4
6,223,367 B1 * 5/2001 French ..... A45C 3/10 383/4
6,952,845 B1 * 10/2005 Akkad ..... A45F 4/02 383/4
7,000,274 B2 * 2/2006 Matthews Brown .. A47D 13/08 5/490
7,131,156 B1 * 11/2006 Walker-Craft ..... A47G 9/1045 5/655
7,513,001 B1 * 4/2009 Leach ..... A47C 27/086 5/632
7,628,456 B1 * 12/2009 Swartz ..... A47C 7/383 297/393
7,657,955 B1 * 2/2010 Alvistur ..... A47D 13/083 5/639

(Continued)

*Primary Examiner* — Nicholas F Polito
*Assistant Examiner* — Myles A Throop
(74) *Attorney, Agent, or Firm* — Lombard & Geliebter LLP; Eric J. Huang

(57) ABSTRACT

A pillow is provided that includes a u-shaped section having opposing ends. Each of the ends has an extension section extending outward there from. One or more of the extension sections has an opening therein that provides access to a pocket located within the extension section. The pockets preferably contain blanket halves therein removably attachable to each other, which may be removed from the pockets and coupled together to form a larger blanket.

6 Claims, 6 Drawing Sheets

(56) References Cited

U.S. PATENT DOCUMENTS 7,779,492 B2 * 8/2010 Mangano ..... A47C 7/383 5/417
7,900,303 B2 * 3/2011 Mastrosimone-Gese ..... A47D 13/083 5/639
D660,069 S * 5/2012 Beuerle ..... A47G 9/0253 D21/658
2005/0150050 A1 * 7/2005 Wolf ..... A47C 7/383 5/636
2007/0017031 A1 * 1/2007 Kaplan ..... A47G 9/0253 5/636
2009/0133192 A1 * 5/2009 Hassell ..... A47C 7/383 5/639
2011/0309122 A1 * 12/2011 Sternlight ..... A45F 4/02 224/576
2012/0238178 A1 * 9/2012 Wadhwani ..... A47G 9/1045 446/72
2013/0125312 A1 * 5/2013 Harooni ..... A47C 7/383 5/639
2013/0260076 A1 * 10/2013 Hejazifar ..... A47G 9/0207 428/58
2013/0312192 A1 * 11/2013 Lee ..... A47G 9/007 5/639
2013/0312197 A1 * 11/2013 Sanders ..... A47D 5/00 5/655
2014/0007351 A1 * 1/2014 Cohen ..... A47G 9/10 5/639
2014/0317844 A1 * 10/2014 Jacobsen ..... A47G 9/068 5/482
2014/0352062 A1 * 12/2014 Messina ..... A47G 9/0238 5/485
2015/0121627 A1 * 5/2015 O'Donnell ..... A41D 1/205 5/639
2015/0196126 A1 * 7/2015 Bowe ..... A47C 7/66 2/104
2015/0196851 A1 * 7/2015 Myers ..... A63H 33/004 446/80
2015/0305523 A1 * 10/2015 Zimmermann ..... A47G 9/023 5/486
2015/0320244 A1 * 11/2015 Li ..... A47G 9/062 5/482
2015/0366382 A1 * 12/2015 Ostolaza-Torres ..... A44B 17/00 5/485
2016/0022045 A1 * 1/2016 Lee ..... A61F 9/04 5/639
2016/0088953 A1 * 3/2016 Benezri ..... A47D 13/063 224/261
2017/0000273 A1 * 1/2017 Mitchell ..... A47C 7/383
2017/0027346 A1 * 2/2017 Konigsberg ..... A47G 9/066
2017/0065109 A1 * 3/2017 Peel ..... A63H 3/02
2017/0086607 A1 * 3/2017 Wong ..... A47G 9/1072

* cited by examiner

NECK PILLOW WITH COMPARTMENT FOR BLANKET

The present application claims priority to U.S. Provisional Patent Application No. 62/199,283, filed Jul. 31, 2015, which is incorporated herein by reference.

BACKGROUND OF THE INVENTION

The present application relates to pillows and more particular to neck pillows.

Travel pillows have been used for some time. Neck pillows, for example, are common items for travelers to support their heads when in a semi-upright seating position for long flights. Existing neck pillows, however, are used for only this specific purpose. Travelers must therefore bring with them other products, such as blankets, to keep them warm. Travelers may find that their neck pillow or blanket not even be necessary for both legs of a trip, and chose to go without rather than hauling cumbersome pillows/blankets with them throughout their travels. Accordingly, there is a need for a neck pillows that are not so limited.

SUMMARY

A pillow is provided that includes a u-shaped section having opposing ends, a first extension section extending outward of a first of the opposing ends, and a second extension section extending outward of a second of the opposing ends, at least one of the extension sections having an opening that provides access to a pocket located within the extension section.

In at least one embodiment, a plurality of extension sections each have an opening therein that provide access to a pocket within the extension section.

In at least one embodiment, the opening in the extension section is located within a concave form of the pillow.

In at least one embodiment, a fastener that releasably encloses the pocket within the extension section.

In at least one embodiment, a blanket half removably located within the pocket of the extension section.

In at least one embodiment, the neck pillow comprises a lanyard releasably connected to a connector located on the blanket half.

In at least one embodiment, the connector is located at a corner of the blanket half.

In at least one embodiment, a plurality of extension sections each have an opening therein that provide access to a pocket within the extension section, and wherein the pillow comprises a blanket half removably located within the pocket of each of the extension sections.

In at least one embodiment, the neck pillow includes at least one lanyard releasably connected to a connector located on at least one of the the blanket halves.

In at least one embodiment, the connector is located at a corner of the blanket half.

In at least one embodiment, the blanket halves comprise complementary fasteners for fastening the blanket halves together.

In at least one embodiment, the pillow includes a character element attached to an end of at least one of the extension sections.

DETAILED DESCRIPTION OF THE INVENTION

The pillow may be used by adults and children, with the child product including an animal head at one of the ends. Essentially, the neck pillow includes at least one extension or preferably a plurality of extensions that extend the neck pillow for travel. Each of the portions extended beyond a standard U-neck pillow has one or a plurality of compartments or pockets therein that stores half of a blanket on each side, i.e., a first blanket half and a second blanket half. The blanket halves can be joined to create one large blanket or they can be used separately. The blanket halves may be joined with a zipper, snaps, buttons, hook and loop fasteners, etc. Each blanket half may be attached to the neck pillow via a lanyard, e.g., elastic cord and clasp, as shown. The advantage of this is that the blanket won't slip off during use and won't be lost. The clasp allows the blankets to be detached.

The pillow may also include an inside pocket which could hold a passport, wallet, phone, tickets, etc., for easy access while traveling. This can remain around a traveler's neck in flight or other transportation method. The pocket can be an added piece of fabric sewn on 3 sides, with or without a means for enclosing the pocket. The pillow may also have a strap on the back/top side so this can be hand carried.

The product may vary in size. For example, it may be 10-12 inches wide, and 15-18 inches long. The blanket may be about 30×48 inches when the halves are connected. The pillow may be made from any fabric that is soft and comfortable to the touch.

Figure 1:
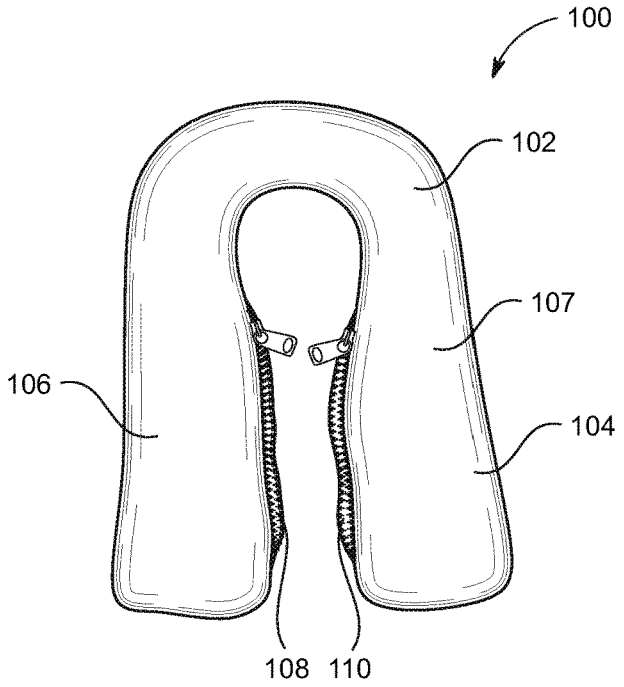
FIG. 1 is an image of a neck pillow according to one embodiment of the pillows disclosed herein, having a pair of extension that each house a blanket half therein.

Referring to FIGS. 1-11, the present application provides a neck pillow according to at least one embodiment. Referring to FIG. 1, the neck pillow 100 has a semi-circular or U-shaped section 102 with a first extension 104 and a second extension 106 extending outward from each end of the semi-circular section 102. Moreover, at least one or preferably each of the extension sections has an opening 108, 110 that provide access to a pocket 122 (as seen best with reference to FIGS. 3, 4, 6, and 7) within the extension section. The opening is preferably located within the concave form of the neck pillow, as shown. The U-shaped pillow (the stuffing) 105 (as seen best with reference to FIG. 10) may be removable from the neck pillow 100. That is, the U-Shaped section 102 and extension sections 104, 106 may be a U-shaped pillow casing 107 with a plurality of openings 108, 110 within the concave of the neck pillow. In this regard, a separate stuffed neck pillow 105 with the essential shape and size of the U-shaped section 102 may fit within the pillow casing 107 to provide the stuffing between the extension sections 104, 106.

Figure 2:
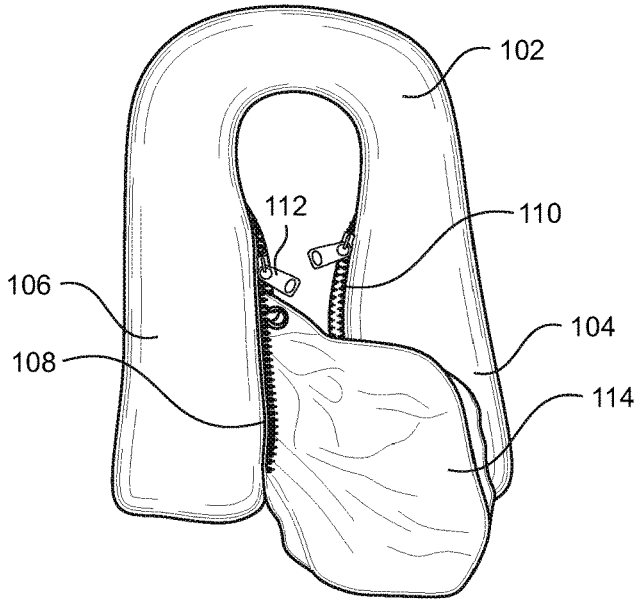
FIG. 2 is an image of the neck pillow with a blanket half released from a first of the extensions.
Figure 3:
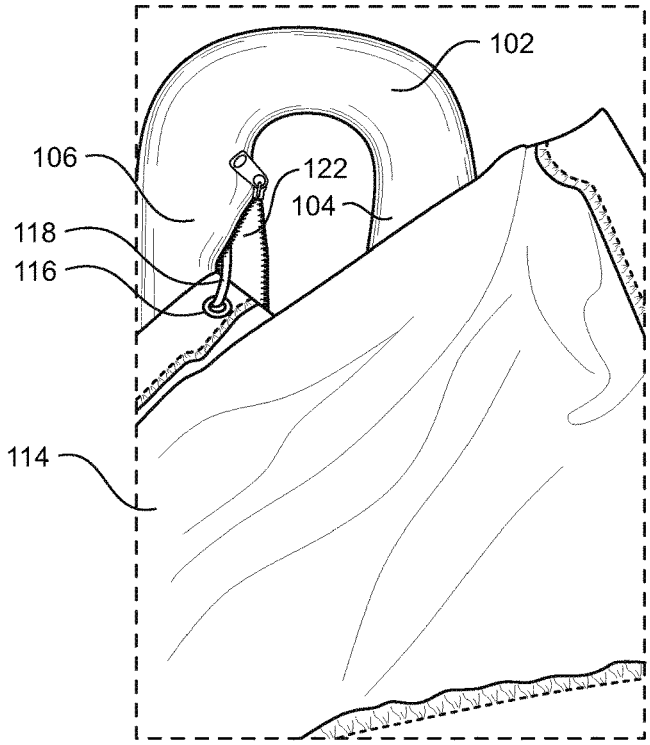
FIGS. 3-4 are images of the neck pillow with both blanket halves released from the pair of extensions.
Figure 4:
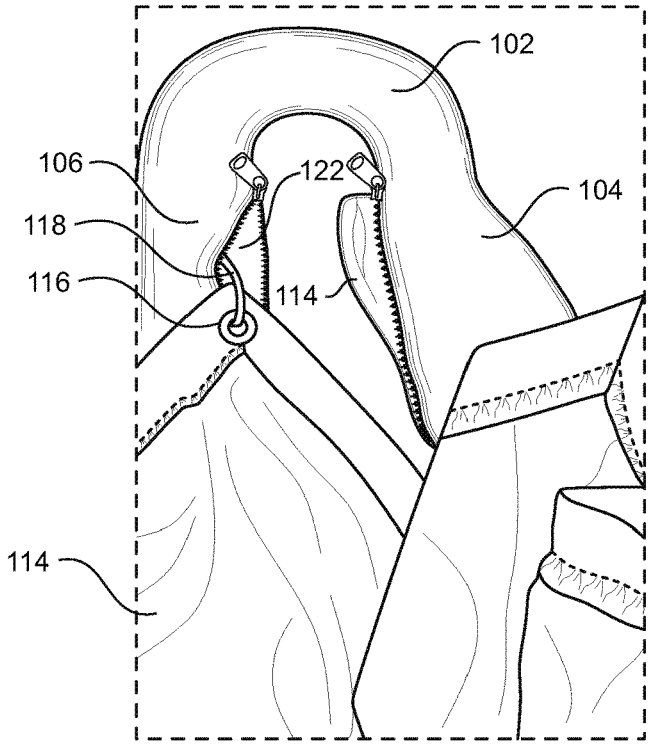

Referring to FIG. 2, the opening 108, 110 preferably includes a fastener 112 or some other means for enclosing the pocket 122 (as seen best with reference to FIGS. 3, 4, 6, and 1) within the extension section, such as a zipper, hook and loop fastener, buttons, snaps, etc. In at least one embodiment, the extension section 104, 106 contain therein a blanket or blanket half 114. Referring to FIGS. 3-4, the blanket half 114 preferably includes at a corner, a first connector 116 that removably connects the blanket half 114 to the extension 108, 110 via a corresponding second connector 118. This connection may be to the stuffed pillow 105 or the pillow casing 107. The first connector maybe a loop and the second connector may be a lanyard that removably connects to the loop. The lanyard 118 is preferably attached to the inside of the pocket 122 within the extension section (as seen best with reference to FIG. 7), i.e., to the stuffed pillow 105 (as seen best with reference to FIG. 10) or the pillow casing 107.

Figure 5:
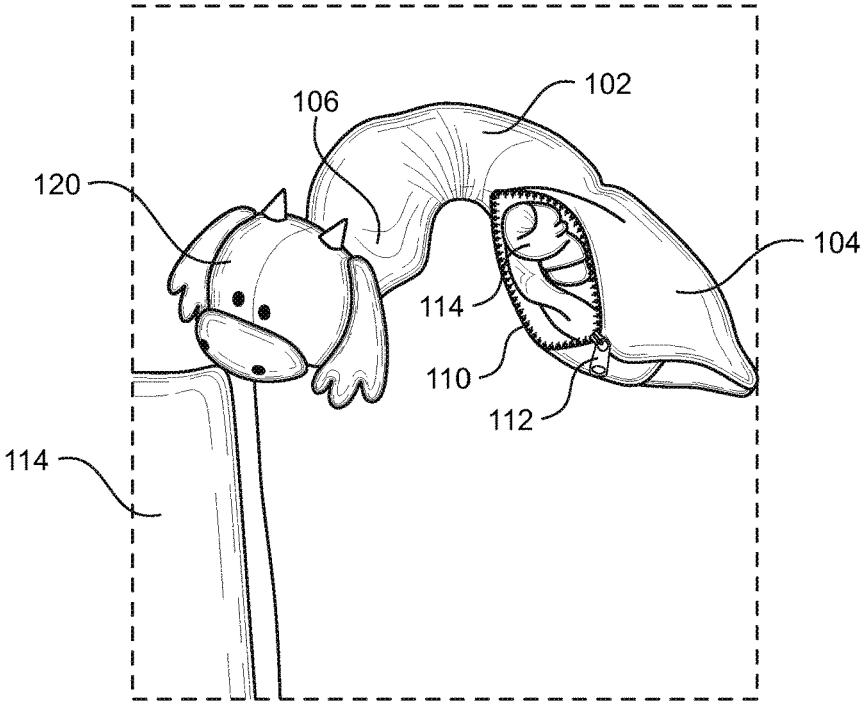
FIG. 5 is an image of a character neck pillow according to one embodiment of the pillows disclosed herein, having a pair of extension that each house a blanket half therein. The blanket half includes a zipper or other enclosure means to retain the blanket half in the extension.
Figure 6:
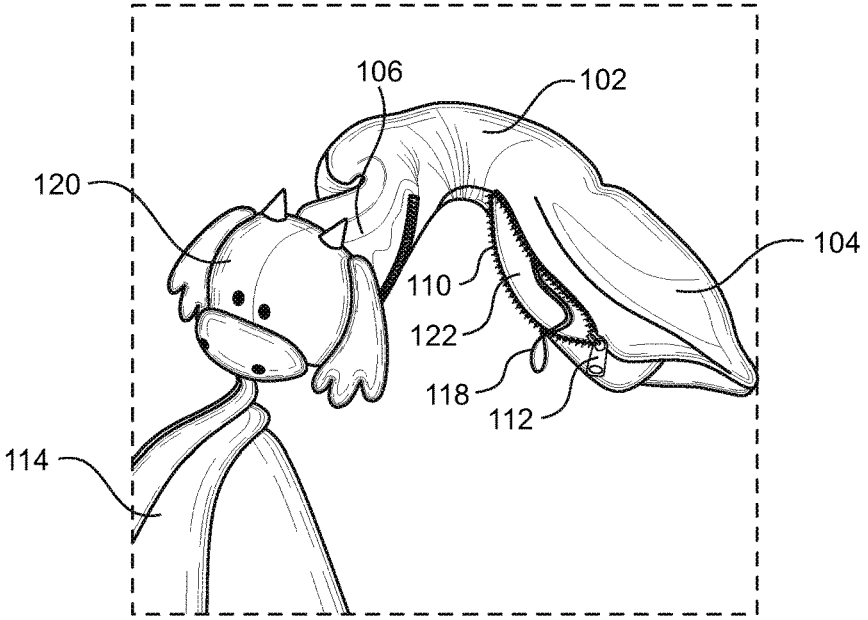
FIG. 6 is an image of the character neck pillow showing a blanket half removed entirely from an extension. Also shown is a cord with a loop therein for attaching the blanket half to the extension. The other blanket half is shown attached to the cord of the other extension.
Figure 7:
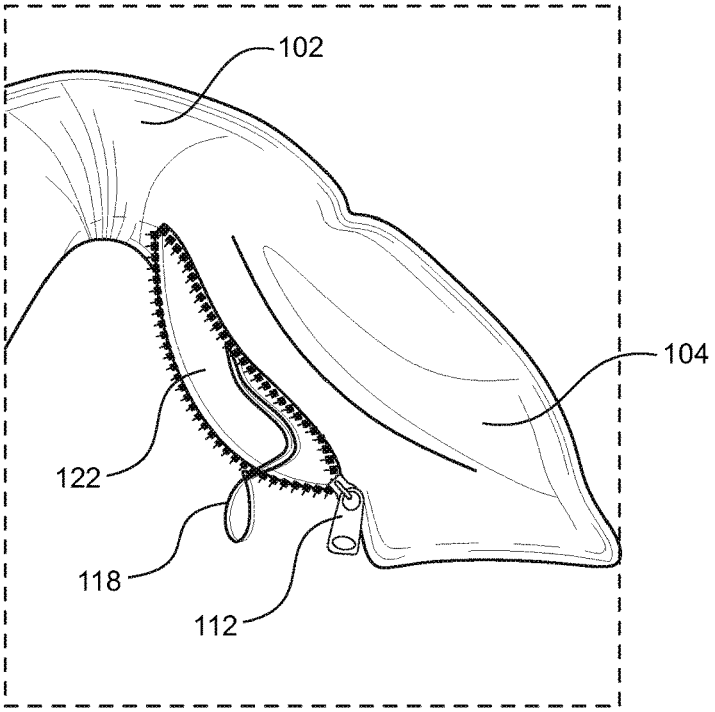
FIG. 7 is a close up view of the extension half and cord.
Figure 8:
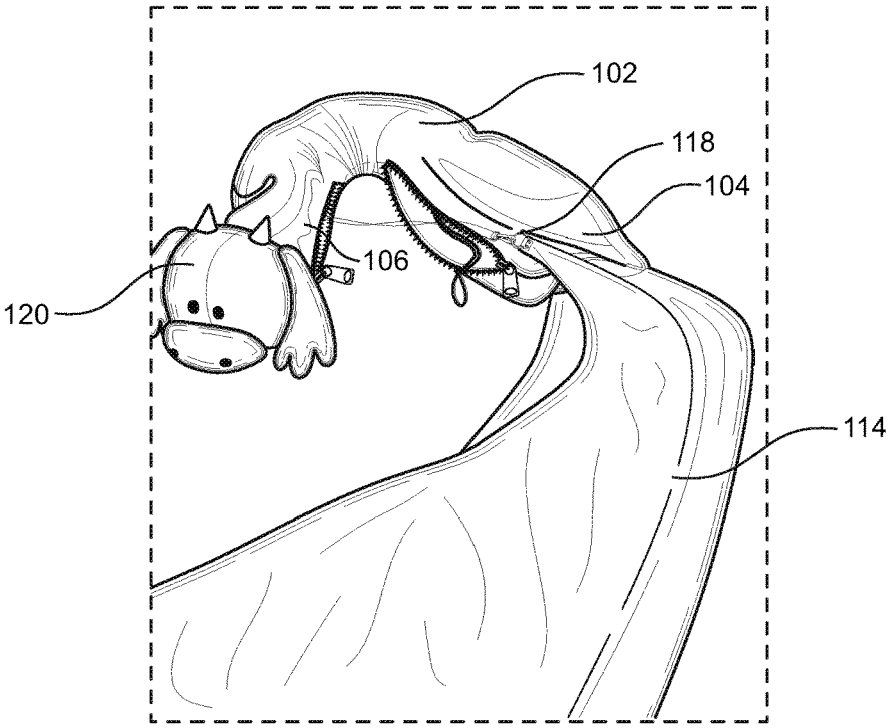
FIG. 8 is an image showing the blanket half removably attached to the cord of the other extension.
Figure 9:
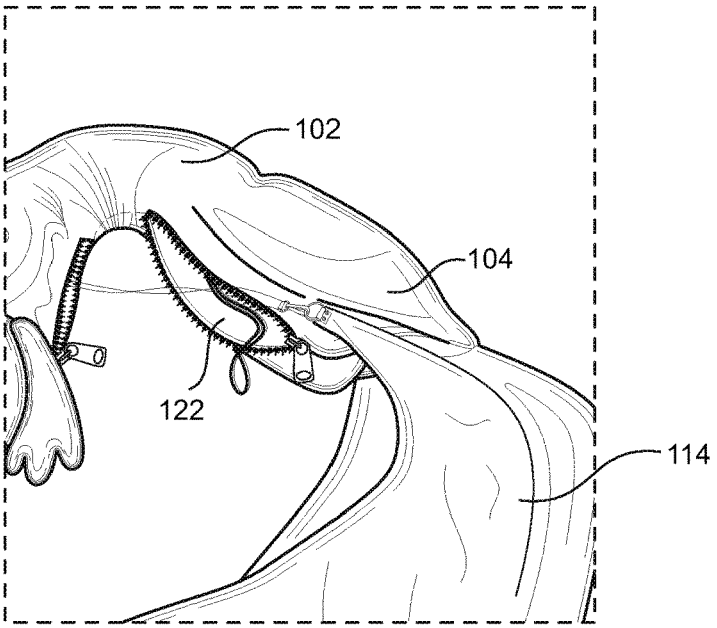
FIGS. 9-11 are images showing both blanket halves attached to a cord on a respective one of the plurality of extensions. Also shown are the blanket halves attached to each other to form a larger blanket.
Figure 10:
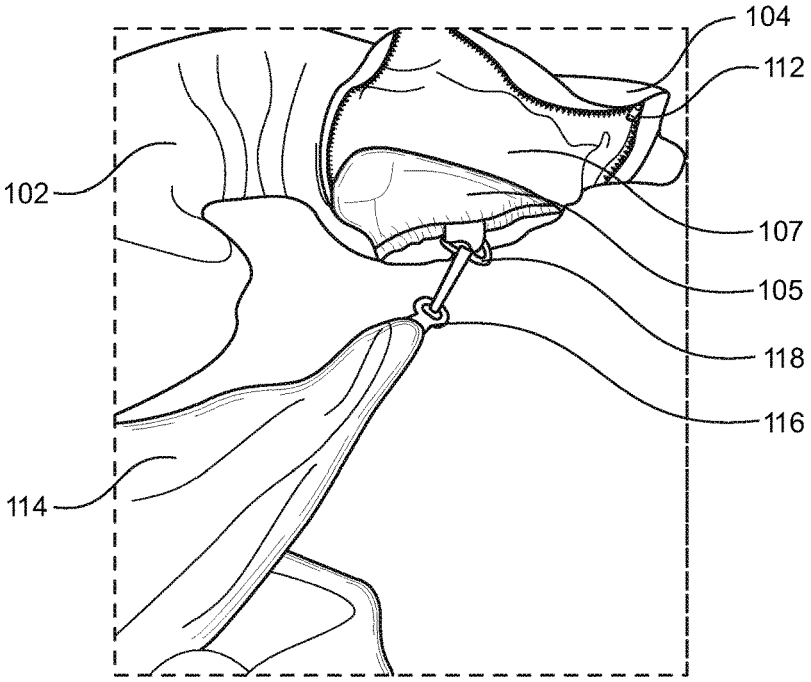
Figure 11:
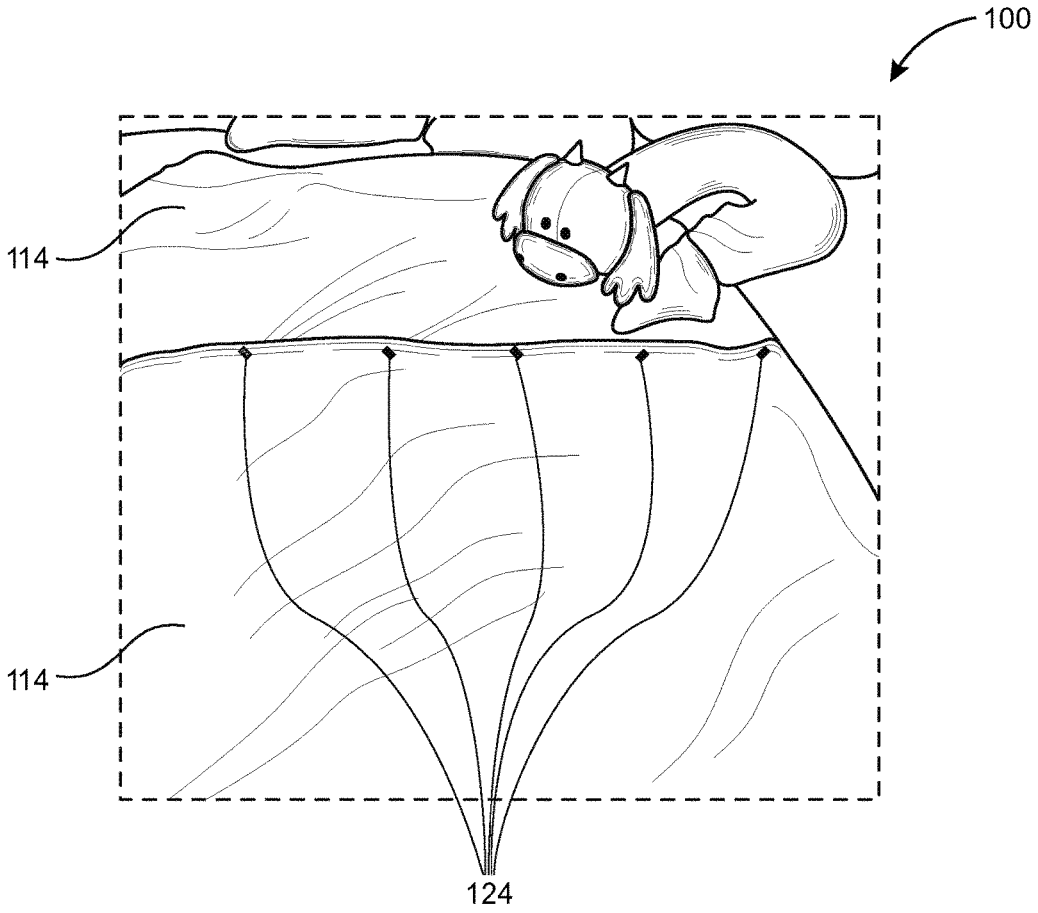

Referring to FIG. 5, on one embodiment, the neck pillow 100 includes a character element 120 attached to an end thereof. The neck pillow 100 is generally used by unfastening fastener 112 to reveal the contents of the extension pocket 122 in this instance, blanket half 114. The same may be performed on the opposite extension pocket 122 to reveal the second blanket half 114. The blanket half 114 may be released from the lanyard entirely, as shown in FIGS. 6 and 7. Alternatively, the blanket half 114 may remain connected to the lanyard, as also shown in FIGS. 8-10. The lanyard connection beneficially maintains the blanket on the user while sitting in an upright position. Referring to FIG. 10, the blanket halves may further have fasteners 124 to releasably attach the blanket halves together to form a single, larger blanket consisting of the two halves. The fasteners 124 may be buttons, snaps, hook and loop, zippers, etc.

In at least one embodiment fabric tabs cover the fasteners 112 (zipper) when closed to avoid irritating the user's neck. Additionally, a small sack may be provided that is stuffed with one or both halves of the blanket to provide the filling for an instant extra pillow. The sack could be stored easily inside the extension pockets.

While the foregoing invention has been described in some detail for purposes of clarity and understanding, it will be appreciated by one skilled in the art, from a reading of the disclosure, that various changes in form and detail can be made without departing from the true scope of the invention.

The invention claimed is:

1. A pillow comprising:

a pillow casing having a u-shaped section having opposing ends, a first extension section extending outward of a first of the opposing ends, and a second extension section extending outward of a second of the opposing ends, a u-shaped stuffed pillow disposed within the u-shaped section of the pillow casing and between the extension sections, the u-shaped stuffed pillow having the same essential shape and size of the u-shaped section, the first of the opposing ends of the u-shaped section and the interior of the first extension section defining a first pocket located within the first extension section, the second of the opposing ends of the u-shaped section and the interior of the second extension section defining a second pocket located within the second extension section, the first extension section having a first distal end and a first concave inner periphery adjacent to the first distal end, the first concave inner periphery having an opening that provides access to the first pocket, the second extension section having a second distal end and a second concave inner periphery adjacent to the second distal end and the first concave inner periphery, the second concave inner periphery having an opening that provides access to the second pocket, a first rectangular-shaped blanket half separate from the pillow and removably located within the first pocket of the first extension section, and a second rectangular-shaped blanket half separate from the pillow and removably located within the second pocket of the second extension section, wherein each of the blanket halves comprises a plurality of complementary fasteners along a straight side of each of the blanket halves for attaching the blanket halves directly together to each other at the fasteners along each of the straight sides to form a single continuous blanket comprising the first blanket half and the second blanket half, wherein the single continuous blanket is configured to be over or covering a user, wherein each of the blanket halves further comprises a first connector located on each of the blanket halves and the pillow further comprises two second connectors, wherein each of the two second connectors is releasably connected to each of the first connectors, wherein each of the second connectors is attached through the inside of the respective pocket, within each of the extension sections, to the stuffed pillow, and wherein the openings to the pockets are further configured to allow the single continuous blanket comprised of the attached blanket halves to be adapted to cover a user whose neck is resting within the u-shaped section.

2. The pillow of claim 1, comprising a fastener that releasably encloses each of the pockets within the each of the extension sections.

3. The pillow of claim 1, wherein each of the first connectors is located at a respective corner of each of the blanket halves.

4. The pillow of claim 1, comprising a character element attached to an end of at least one of the extension sections.

5. The pillow of claim 1, wherein the pockets are sized such that each may contain the rectangular-shaped blanket half of such size as is required for the single continuous blanket configured to be over or covering a user.

6. The pillow of claim 1, wherein the second connector is a lanyard.

* * * * *